United States Patent [19]

Grossman et al.

[11] Patent Number: 4,464,010

[45] Date of Patent: Aug. 7, 1984

[54] ARRANGEMENT FOR DETACHABLY CONNECTING A WIRE TO A CIRCUIT BOARD CONDUCTOR

[75] Inventors: Kurt Grossman, Hallerndorf; Jürgen Bliesner, Hemhofen, both of Fed. Rep. of Germany

[73] Assignee: Siemens Aktiengesellschaft, Berlin and Munich, Fed. Rep. of Germany

[21] Appl. No.: 469,629

[22] Filed: Feb. 25, 1983

[30] Foreign Application Priority Data

Mar. 5, 1982 [DE] Fed. Rep. of Germany ..... 3208065

[51] Int. Cl.[3] ..... H01R 4/36

[52] U.S. Cl. ..... 339/272 R; 339/17 C

[58] Field of Search ..... 339/176 MP, 17 F, 17 C, 339/103, 263

[56] References Cited

U.S. PATENT DOCUMENTS

| | | | |
|---|---|---|---|
| 2,956,215 | 10/1960 | Andrea et al. | 339/17 C |
| 3,075,167 | 1/1963 | Kinkaid | 339/176 MP |
| 3,112,145 | 11/1963 | Swengel | 339/103 M |
| 3,378,806 | 4/1968 | Wilkerson et al. | 339/17 C |
| 3,622,943 | 11/1971 | Reimer | 339/103 M |
| 3,624,588 | 11/1971 | Farmer | 339/17 C |
| 3,744,009 | 7/1973 | Teagno et al. | 339/17 C |
| 3,851,294 | 11/1974 | Palazzetti et al. | 339/17 F |
| 3,989,332 | 11/1976 | Patterson et al. | 339/17 C |
| 4,181,386 | 1/1980 | Olsson | 339/17 F |
| 4,295,696 | 10/1981 | Gray | 339/103 M |

*Primary Examiner*—Joseph H. McGlynn
*Assistant Examiner*—David L. Pirlot
*Attorney, Agent, or Firm*—Kenyon & Kenyon

[57] ABSTRACT

An arrangement for mechanically and electrically coupling a heavy gauge wire, which may be a multiconductor wire, to a conductor lamination of a circuit board. The circuit board is provided with two substantially parallel slots extending inwardly from the edge of the circuit board and on either side of the conductor lamination. A clamping cage which is formed from a strip of sheet metal to have a substantially box-like configuration has two lateral portions which engage the substantially parallel slots. Two contact plates are arranged on respective sides of the circuit board and within the clamping cage. The contact plates are each provided with laterally extending tabs which bridge the slots. The clamping cage is provided with a contact portion for securing the heavy gauge wire to the contact plate on the conductor lamination side of the circuit board. The other end of the clamping cage is provided with an engagement portion which, in one embodiment, engages with a screw which is forced against the other contact plate to secure the clamping cage and the wire firmly to the circuit board. In a further embodiment, the conductor lamination extends beyond the slots, and electrical contact is made therewith via the laterally extending tabs of the contact plates. In embodiments where both sides of the circuit board are provided with conductor laminations, through holes may be provided in the region intermediate of the slots, which holes are metalized. Also, the edges of the slots may be metalized to provide electrical communication between the conductor laminations. The laterally extending tabs distribute forces which would otherwise bend the region intermediate of the slots to the remainder of the circuit board.

6 Claims, 5 Drawing Figures

ARRANGEMENT FOR DETACHABLY CONNECTING A WIRE TO A CIRCUIT BOARD CONDUCTOR

BACKGROUND OF THE INVENTION

This invention relates generally to detachable electrical connections, and more particularly, to a detachable connection between a wire and a conductor of a circuit board.

The development of heavy duty electronic components having high current carrying capacity, such as high voltage switching transistors, has caused a corresponding increase in the currents which must be controlled safely in circuit boards, such as printed circuit boards, on which such components are mounted. One of the major problems in the state of the art pertains to the connection of supply lines to the conductor laminations of such circuit boards. Oftentimes, such supply lines must have a cross-sectional area which is sufficient to conduct currents in the range of 50 amps, and more. In commercially available circuit boards of the type mentioned herein, the connections between the supply lines and the conductor laminations are generally achieved by wave-soldered cables, or by pressed-in and wave-soldered threaded inserts to which the supply line conductors are screwed firmly. It is a problem with such arrangements for supplying high powered circuit boards that the contact resistances are relatively high. Thus, during periods when large currents are flowing, excessive temperatures are reached in the region of the contact causing excessive temperature stresses in the circuit board and its conductor laminations. In addition to the foregoing, the rigid connection of heavy wiring or cables to the circuit board produces bending stresses which can eventually result in failure of the circuit board.

It is, therefore, an object of this invention to provide an arrangement for detachably connecting a supply line to a conductor lamination of a circuit board such that only a low contact resistance is produced.

It is a further object of this invention to provide a mechanical connection between a wire and a conductor lamination of a circuit board wherein only small mechanical stresses are produced in the circuit board in the region of the connection.

SUMMARY OF THE INVENTION

The foregoing and other objects are achieved by this invention which provides an arrangement for connecting a wire to a circuit board wherein the circuit board is provided with two substantially parallel slots which extend inwardly from the edge of the circuit board. In the circuit board area between the two slots, a conductor lamination is provided on at least one side of the circuit board. A clamping cage having two lateral portions is arranged to surround the area between the slots such that the lateral portions are inserted through respective ones of the slots. There are further provided two contact plates which are arranged on either side of the circuit board and movably between the lateral portions of the clamping cage. Each of the contact plates is provided with laterally extending tabs which at least partially bridge the slots on both sides of the circuit board. A wire to be connected is inserted between one of the contact plates which is situated on the conductor lamination and the clamping cage. Clamping of the wire is achieved by a clamping device which engages between the contact plate on the other side of the circuit board and the clamping cage.

In accordance with the invention, the electrically conducting contact plate which is in direct contact with the clamped wire is also in direct contact with the conductor lamination of the circuit board, thereby producing a large contact area. Thus, the contact resistance of this connection in the contact area is very low, and excessive temperature stresses of the circuit board, particularly of the conductor lamination in the region of the connection, do not occur. Since the lateral portions of the clamping cage are inserted into the slots in a form-locking manner, forces exerted upon the plane of the circuit board, particularly torques, are distributed into the circuit board. Forces which tend to bend the circuit board by acting in a direction perpendicular to the plane of the circuit board are distributed into the circuit board by the laterally extending tabs of the contact plates which bridge the slots. In this manner, the conductor lamination and circuit board portion contained between the slots are relieved of such stresses. The inventive arrangement therefore provides a connection which meets the stated requirements and which can be produced simply and inexpensively, and in production quantities using few parts.

In a further embodiment of the invention, bending forces which would act on the conductor lamination and circuit board portion intermediate of the slots are reduced further in this area if the laterally extending tabs of the contact plates are arranged so as to be aligned with one another. Such registration of the contact plates and their tabs results in a distribution of such bending forces into the circuit board.

In one particularly advantageous embodiment of the invention, the conductor lamination of the circuit board is arranged to extend along both sides of each slot. The portion of the conductor lamination which extends outside of the slots is electrically contacted by the laterally extending tabs of the contact plates, thereby reducing the current density in the conductor lamination in the vicinity of the connection. In embodiments where conductor laminations are provided on both sides of the circuit board in the vicinity of the connection, one or more through-contacted holes can be arranged in the circuit board region intermediate of the slots. In this manner, the distribution of current over the two conductor lamination sides is improved. Moreover, the slots themselves can be metalized for establishing through-contacts. In this manner, the conductor laminations are adapted to conduct very high currents.

BRIEF DESCRIPTION OF THE DRAWINGS

Comprehension of the invention is facilitated by reading the following detailed description in conjunction with the annexed drawings, in which.

DETAILED DESCRIPTION

Figure 1:
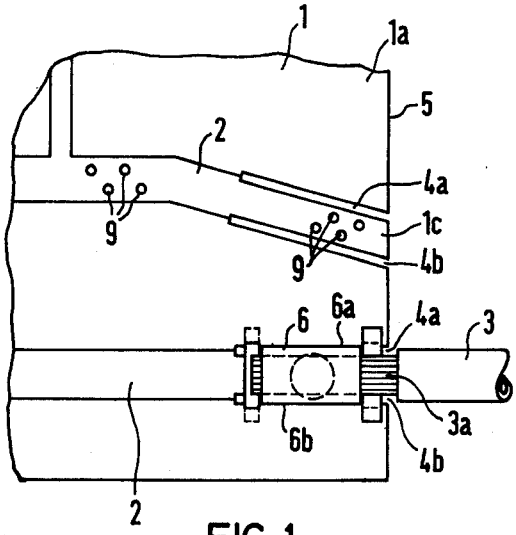
FIG. 1 is a top view of a circuit board showing a connection to a supply wire in accordance with the invention.

FIG. 1 represents a top view of a circuit board 1 having conductor laminations 2 which are provided for connecting to a wire 3. As shown, wire 3 is provided with a relatively large cross-section so as to have a large current-carrying capacity. Each of conductor laminations 2 is provided with a pair of substantially parallel slots 4*a* and 4*b* which extend inwardly from an edge 5 of the circuit board. In this embodiment, a circuit board portion 1*c* which is intermediate of slots 4*a* and 4*b* is completely covered by conductor lamination 2. As shown in the specific illustrative embodiment of FIG. 1, the conductor laminations which are adapted for the connection in accordance with the invention need not be arranged at right angles with respect to the edge of the circuit board.

FIG. 1 shows only one conductor lamination 2 connected in accordance with the invention to a single multiconductor wire 3 to preserve the clarity of the drawing. In accordance with this embodiment of the invention, a plurality of conductors 3*a* of wire 3 are clamped in a clamping cage 6.

Figure 2:
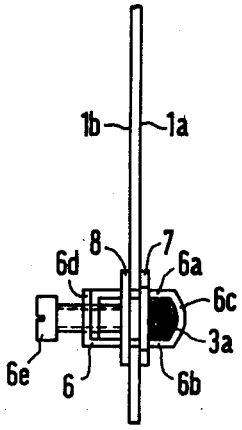
FIG. 2 is a front view of the connection in FIG. 1.
Figure 3:
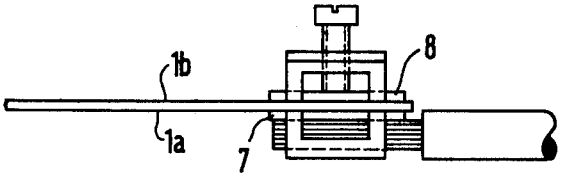
FIG. 3 is a side view of the connection in FIG. 1.

FIGS. 2 and 3 show front and side views of clamping cage 6. As shown, the clamping cage is bent from a metal strip in a box configuration. The clamping cage is provided with lateral portions 6*a* and 6*b* which are inserted in a substantially form-locking manner into slots 4*a* and 4*b*, respectively, of circuit board 1. A pair of contact plates 7 and 8 are provided on each circuit board side 1*a* and 1*b*. In accordance with the invention, at least contact plate 7, which is arranged to be adjacent to, and in electrical contact with, conductors 3*a* of wire 3, is arranged to be in contact with conductor lamination 2. Conductors 3*a* of wire 3 are clamped between contact plate 7 and a connecting bridge portion 6*c* of clamping cage 6. A clamping device, which is a clamping screw 6*e* in this embodiment, is screwed into a connecting bridge 6*d* of clamping cage 6 so as to rest on contact plate 8. The tightening of clamping screw 6*e* urges connecting bridge 6*c* against conductors 3*a*, and contact plate 7 is urged firmly against conductor lamination 2.

Figure 4:
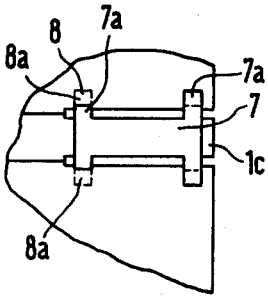
FIG. 4 is a top view of the contact plates without the clamping cage.

FIG. 4 is a top view showing the shapes of contact plates 7 and 8 without clamping cage 6. Each of the contact plates is provided with laterally extending tabs 7*a* and 8*a*, respectively, which have a sufficient length to bridge slots 4*a* and 4*b*. In the specific illustrative embodiment, tabs 7*a* and 8*a* are arranged at respective ends of contact plates 7 and 8 so as to produce a double T configuration. In this top view, the laterally extending tabs of the contact plates are arranged to coincide when the connector arrangement is assembled. Tabs 7*a* and 8*a* serve to transmit bending forces which act perpendicularly to the plane of the circuit boards to the entire circuit board. Thus, the conductor lamination and circuit board portion 1*c* between slots 4*a* and 4*b* is relieved of the bending forces. In accordance with the embodiment of FIG. 4, tabs 7*a* and 8*a* at the ends of contact plates 7 and 8 are of different lengths. Such different lengths facilitate insertion of the contact plates into the box-like interior of the clamping cage.

Figure 5:
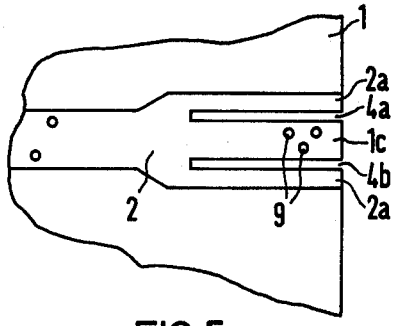
FIG. 5 is a top view of a conductor lamination on a circuit board in the region of a connection wherein the conductor lamination extends beyond the region intermediate of the slots.

FIG. 5 shows a further embodiment of the conductor lamination. In this embodiment, conductor lamination 2 is not limited to the area between slots 4*a* and 4*b*. Instead, the conductor lamination extends to regions 2*a* outside of the slots. Regions 2*a* of the conductor lamination of the circuit board are contacted by tabs 7*a* and 8*a* so as to reduce the current density in the conductor lamination.

In a particularly advantageous embodiment of the invention, conductor laminations 2 are arranged congruently on both sides 1*a* and 1*b* of circuit board 1. In such an embodiment, a plurality of holes 9 are located in the region of circuit board portion 1*c*, and metalization is deposited through the holes. Such through contacting via holes 9 assures good current distribution over both sides of the circuit board.

It should be noted that the mechanical advantages of the present invention are not limited to forces and moments which act perpendicularly with respect to the plane of the circuit board. Since lateral portions 6*a* and 6*b* of clamping cage 6 engage slots 4*a* and 4*b* in a substantially form-locking fit, other forces which act in the plane of the circuit board, illustratively torques resulting from the screw connection, are distributed into the circuit board.

As a result of the large contact areas between contact plates 7 and 8 and conductors 3*a* of wire 3, a low contact resistance is achieved between the wire and the conductor laminations. This produces the advantage that only a slight temperature rise is obtained while the mechanical forces which are imparted to the circuit board by wire 3 as a result of its inflexibility are distributed over the entire circuit board. In this manner, disturbances in the operation of the circuit board which would be produced by the mechanical stresses are practically eliminated.

Although the invention has been described in terms of specific embodiments and applications, persons skilled in the art, in light of this teaching, can generate additional embodiments without exceeding the scope or departing from the spirit of the claimed invention. Accordingly, it is to be understood that the drawings and descriptions in this disclosure are proffered to facilitate comprehension of the invention and should not be construed to limit the scope thereof.

What is claimed is:

1. An arrangement for detachably connecting a wire to a conductor lamination of a circuit board, the arrangement comprising:

a first conductor lamination portion arranged on the circuit board to extend inwardly thereon from a region in the vicinity of an edge of the circuit board and intermediate of first and second circuit board slots which are substantially parallel with each other and arranged to extend inwardly from an edge of the circuit board;

a clamping cage having first and second lateral portions for engaging in said first and second circuit board slots, respectively, a contact bridge portion mechanically coupled to said first and second lateral portions for holding the wire and arranged on a side of the circuit board where said first conductor lamination portion is arranged, and an engagement bridge portion mechanically coupled to said first and second lateral portions for securing said clamping cage;

first and second contact plates movably arranged on respective sides of the circuit board and within said clamping cage, each contact plate being provided with laterally extending tabs for bridging said first and second circuit board slots, the wire being interposed between said first contact plate and said contact bridge portion of said clamping cage; and engagement means for engaging with said engagement bridge portion of said clamping cage and said second contact plate for securing said contact bridge portion of said clamping cage against the wire.

2. The arrangement of claim 1 wherein said laterally extending tabs of said first and second contact plates are arranged congruently with respect to each other on either side of the circuit board.

3. The arrangement of claim 1 wherein said first conductor lamination portion is arranged to extend beyond and surround said first and second circuit board slots.

4. The arrangement of claim 1 wherein there is further provided a second conductor lamination portion on the other side of the circuit board from said first conductor lamination portion, said first and second conductor lamination portions being electrically coupled to each other.

5. The arrangement of claim 4 wherein said first and second conductor lamination portions are electrically coupled to each other in a region intermediate of said first and second circuit board slots via through holes.

6. The arrangement of claim 4 wherein said first and second conductor lamination portions are electrically coupled to each other via metalized edges of said first and second circuit board slots.

* * * * *